US008808954B2

(12) United States Patent
Matsusaki et al.

(10) Patent No.: US 8,808,954 B2
(45) Date of Patent: Aug. 19, 2014

(54) ELECTROPHOTOGRAPHIC PHOTOCONDUCTOR, PROCESS CARTRIDGE INCLUDING THE SAME, AND IMAGE FORMING APPARATUS INCLUDING THE SAME

(75) Inventors: Mayuko Matsusaki, Tokyo (JP); Tomoo Sakimura, Tokyo (JP); Shinichi Hamaguchi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 24 days.

(21) Appl. No.: 13/466,192

(22) Filed: May 8, 2012

(65) Prior Publication Data

US 2012/0288300 A1 Nov. 15, 2012

(30) Foreign Application Priority Data

May 10, 2011 (JP) ..... 2011-105616

(51) Int. Cl.
*G03G 5/00* (2006.01)
*G03G 5/14* (2006.01)
*G03G 5/06* (2006.01)

(52) U.S. Cl.
CPC ..... *G03G 5/144* (2013.01); *G03G 2215/00957* (2013.01); *G03G 5/0696* (2013.01)
USPC ..... 430/60; 430/64; 430/65

(58) Field of Classification Search
USPC ..... 430/60, 64, 65
See application file for complete search history.

(56) References Cited

U.S. PATENT DOCUMENTS 5,716,745 A * 2/1998 Minemura et al. ..... 430/64
5,998,072 A * 12/1999 Mochizuki et al. ..... 430/64
2008/0273897 A1* 11/2008 Ezumi et al. ..... 399/159

FOREIGN PATENT DOCUMENTS

JP 58-189061 11/1983
JP 2002-196522 7/2002

(Continued)

OTHER PUBLICATIONS

Office Action dated Jun. 11, 2013 issued in related Japanese Application No. JP 2011-105616 with its English translation (8 pages).

*Primary Examiner* — Mark A Chapman
(74) *Attorney, Agent, or Firm* — Lucas & Mercanti, LLP

(57) ABSTRACT

The present invention provides an electrophotographic photoconductor that can improve unevenness in image density and reduce image defects such as fogging and dots. The electrophotographic photoconductor includes a conductive support, an intermediate layer, and a photosensitive layer. The intermediate layer includes metal oxide particles surface-treated with a titanium chelate compound represented by the following formula (1):

$$Ti(OR)_n(L)_{4-n} \quad (1)$$

wherein R at each occurrence independently represents a $C_{1-16}$ aliphatic hydrocarbon group; L at each occurrence independently represents a ligand derived from a chelating agent selected from the group consisting of β-ketoester represented by the following formula (1a):

(1a)

β-diketone represented by the following formula (1b):

(1b)

and a $C_{3-10}$ alkylene glycol; n represents an integer of 1 to 3; if n is 2 or more, two Rs may be coupled to each other.

6 Claims, 3 Drawing Sheets

(56) References Cited

FOREIGN PATENT DOCUMENTS

| | | | |
|---|---|---|---|
| JP | 2002-236381 | A | 8/2002 |
| JP | 2002-278118 | A | 9/2002 |
| JP | 2002-287471 | A | 10/2002 |
| JP | 2002-311628 | A | 10/2002 |
| JP | 2002-333732 | A | 11/2002 |
| JP | 2003-122039 | A | 4/2003 |
| JP | 2003-122067 | A | 4/2003 |
| JP | 2004-258337 | | 9/2004 |
| JP | 2007-331987 | | 12/2007 |
| JP | 2009-276470 | | 11/2009 |

* cited by examiner

ELECTROPHOTOGRAPHIC PHOTOCONDUCTOR, PROCESS CARTRIDGE INCLUDING THE SAME, AND IMAGE FORMING APPARATUS INCLUDING THE SAME

This Application claims the priority of Japanese Patent Application JP2011-105616 filed May 10, 2011, the entire contents of which are incorporated herein by reference.

TECHNICAL FIELD

The present invention relates to an electrophotographic photoconductor, a process cartridge including the electrophotographic photoconductor, and an image forming apparatus including the electrophotographic photoconductor.

BACKGROUND ART

Electrophotographic photoconductors used in copiers and printers are usually organic photoconductors that include a photosensitive layer containing an organic photoconductive material as a principal component. Such organic photoconductors are classified into two types: those having a single-layered photosensitive layer containing a charge generation material and a charge transport material; and those having laminated photosensitive layers in which a charge generation layer containing a charge generation material and a charge transport layer containing a charge transport material are laminated. Among these, the organic photoconductors having the laminated photosensitive layers, and particularly the negative charge type laminated electrophotographic photoconductors having the surface of the photoconductor to be negatively charged have been widely put to practical use because of their good electrophotographic properties, durability and high freedom of design.

The negative charge type laminated electrophotographic photoconductor usually includes a conductive support, an intermediate layer, a charge generation layer, and a charge transport layer, which are laminated in this order. When the negative charge type laminated electrophotographic photoconductor is light-exposed, it generates charges in the charge generation layer. Among the charges, negative charges (electrons) migrate through the intermediate layer to the conductive support side, and holes migrate through the charge transport layer to the surface of the photoconductor. The holes cancel the negative charges on the surface of photoconductor to form an electrostatic latent image. For this reason, the intermediate layer needs to: 1) quickly allow the electrons generated in the charge generation layer to migrate to the conductive support side (i.e., electron transportability), and 2) suppress injection of holes from the conductive support to the photosensitive layer (i.e., blocking property).

The intermediate layer usually contains metal oxide particles and a binder resin in which the metal oxide particles are dispersed. In order to improve the blocking property of the intermediate layer, increase in dispersibility of the metal oxide particles by surface treatment of the metal oxide particles has been studied. A variety of methods for surface treatment have been proposed: for example, the metal oxide particles contained in the intermediate layer are surface-treated with both of an inorganic compound and an organic compound (for example, PTL 1), or surface-treated with a titanium coupling agent (for example, PTL 2).

CITATION LIST

Patent Literature

PTL 1: Japanese Patent Application Laid-Open No. 2002-196522

PTL 2: Japanese Patent Application Laid-Open No. 2009-276470

SUMMARY OF INVENTION

Technical Problem

Recently, a print system using a dry electrophotographic method is widely used in the field of printing for a relatively small number of copies because the printing system provides improved quality of an image. As a result, in addition to a demand for further improvement in the image quality, the dry electrophotographic print system is more often used in applications such as printing on a coated paper, printing of an image with a high coverage, and a large amount of printing of a high quality image, in which the print system is rarely used in the related art. For this reason, the charging potential in formation of an image is higher than that in the related art. This higher charging potential leads to difficulties in sufficiently blocking the charges which could have been blocked by the intermediate layer in the conventional system, and image defects such as fogging may be produced under a severe condition.

In order to suppress such fogging or the like under a severe condition, the thickness of the intermediate layer containing the surface-treated metal oxide particles in PTLs 1 and 2 may be increased, for example. This method relatively improves the blocking property, but reduces the electron transportability. Hence, the electrons may not be discharged well from the charge generation layer, causing unevenness in image density. Specifically, the electrons may not be sufficiently discharged from the charge generation layer after first round of an image forming process is completed, resulting in unevenness in image density in the subsequent round of the image forming process.

On the other hand, in order to suppress the unevenness in image density, the electron transportability of the metal oxide particles contained in the intermediate layer may be increased, for example, but this results in that the blocking property undesirably worsens. Specifically, due to higher electron transportability of the metal oxide particles, holes are likely to be injected from the conductive support to the photosensitive layer. For the same reason, in an electrophotographic photoconductor having a highly sensitive photosensitive layer, carriers generated by thermal excitation are likely to be leaked. These may partially reduce the surface potential of the photoconductor, causing image defects such as fogging and dots (a dot image in the background or in an image at a coverage rate of 0%). Thus, it is difficult to improve both the electron transportability and blocking property of the intermediate layer.

The present invention has been made in consideration of such circumstances. An object of the present invention is to provide an electrophotographic photoconductor including an intermediate layer having sufficient electron transportability and a sufficient blocking property wherein both of unevenness in image density and image defects such as fogging and dots are reduced.

Solution to Problem

To achieve at least one of the above mentioned objects, an electrophotographic photoconductor, a process cartridge, and an image forming apparatus reflecting one aspect of the present invention are as follows:

[1] An electrophotographic photoconductor including a conductive support, a photosensitive layer disposed on the conductive support, and an intermediate layer disposed between the conductive support and the photosensitive layer, wherein the intermediate layer comprises metal oxide particles and a binder resin, and the metal oxide particles are surface-treated with a titanium chelate compound represented by the following formula (1):

$$Ti(OR)_n(L)_{4-n} \quad (1)$$

wherein

R at each occurrence independently represents a $C_{1-16}$ aliphatic hydrocarbon group; L at each occurrence independently represents a ligand derived from a chelating agent selected from the group consisting of β-ketoester represented by the following formula (1a):

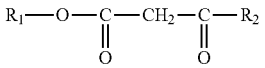

(1a)

wherein $R_1$ and $R_2$ each represent a $C_{1-18}$ aliphatic hydrocarbon group, β-diketone represented by the following formula (1b):

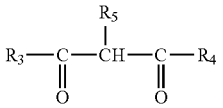

(1b)

wherein $R_3$ to $R_5$ each represent a $C_{1-18}$ aliphatic hydrocarbon group, and $C_{3-10}$ alkylene glycol; n represents an integer of 1 to 3; and if n is 2 or more, two Rs may be coupled to each other.

[2] The electrophotographic photoconductor according to [1], wherein the metal oxide particles are titanium oxide particles.

[3] The electrophotographic photoconductor according to [1] or [2], wherein the average particle size of the metal oxide particles is 10 to 400 nm.

[4] The electrophotographic photoconductor according to any one of [1] to [3], wherein the photosensitive layer comprises a charge generation layer and a charge transport layer, and the charge generation layer comprises a Type Y titanyl phthalocyanine pigment or a mixture of a titanyl phthalocyanine pigment and a pigment of an adduct of 2,3-butanediol and titanyl phthalocyanine.

[5] A process cartridge detachably mountable on an image forming apparatus, the process cartridge including: the electrophotographic photoconductor according to any one of [1] to [4], and at least one unit selected from the group consisting of: a charging unit for charging a surface of the electrophotographic photoconductor; a developing unit for feeding a toner to an electrostatic latent image formed on the surface of the electrophotographic photoconductor; a transferring unit for transferring the toner fed to the surface of the electrophotographic photoconductor onto a recording medium; a discharging unit for discharging the surface of the electrophotographic photoconductor after toner transfer; and a cleaning unit for removing a residual toner from the surface of the electrophotographic photoconductor; wherein the electrophotographic photoconductor and the at least one unit are integrally formed.

[6] An image forming apparatus including: the electrophotographic photoconductor according to any one of [1] to [4]; the charging unit for charging a surface of the electrophotographic photoconductor; an light exposing unit for light-exposing the surface of the electrophotographic photoconductor; a developing unit for feeding a toner to an electrostatic latent image formed on the surface of the electrophotographic photoconductor; a transferring unit for transferring the toner formed on the surface of the electrophotographic photoconductor onto a recording medium; a discharging unit for discharging the surface of the electrophotographic photoconductor after toner transfer; and a cleaning unit for removing a residual toner from the surface of the electrophotographic photoconductor.

DESCRIPTION OF EMBODIMENTS

1. Electrophotographic Photoconductor

Figure 1:
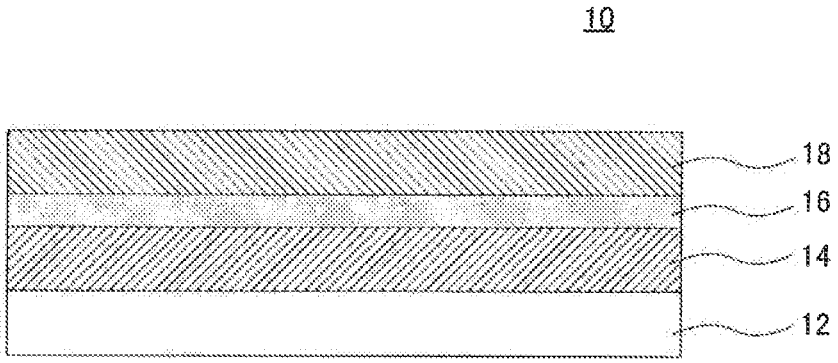
FIG. 1 shows an example of a configuration of layers in an electrophotographic photoconductor according to the present invention.

An electrophotographic photoconductor according to the present invention is a negative charge type laminated electrophotographic photoconductor, in which at least an intermediate layer and a photosensitive layer are laminated on a conductive support, and an over coat layer is further laminated thereon when necessary. A specific example of layer configuration in the electrophotographic photoconductor can be shown below:

1) a layer configuration in which an intermediate layer, a charge generation layer and a charge transport layer as a photosensitive layer, and when necessary, an over coat layer are sequentially laminated on a conductive support; and 2) a layer configuration in which an intermediate layer, a single layer containing a charge transport material and a charge generation material as a photosensitive layer, and when necessary, an over coat layer are sequentially laminated on a conductive support. Hereinafter, the respective layers that form the electrophotographic photoconductor according to the present invention will be described, mainly with respect to the layer configuration 1).

Conductive Support

The conductive support is a cylindrical or sheet-like conductive support. The cylindrical conductive support is adapted to rotate to continuously form an image. In order to form an image with high precision, preferably, the straightness of the cylindrical conductive support is 0.1 mm or less, and the runout thereof is 0.1 mm or less. The runout represents a width of fluctuation in a position of the outer peripheral surface of the rotating conductive support. The runout is measured by a digital size measuring apparatus (made by Keyence Corporation, a sensor head: EX-305V, an amplifier unit: EX-V01).

The conductive support can be a metallic drum made of aluminum, nickel, and the like; a plastic drum having a metal such as aluminum, tin oxide, and indium oxide deposited thereon; and a paper or plastic drum coated with a conductive compound. The resistivity of the surface of the conductive support under normal temperature is preferably $10^3$ mΩ or less.

In order to suppress interference fringes (moire) generated by light exposure, the surface of the conductive support may be subjected to a treatment to form an anodic oxidation coating on aluminum (the anodic oxidation treatment), with the pores in the anodic oxidation coating on aluminum being sealed. Usually, the anodic oxidation treatment can be performed in an acidic bath of chromic acid, sulfuric acid, oxalic acid, phosphoric acid, boric acid, sulfamic acid, and the like. Preferably, the anodic oxidation treatment is performed in a sulfuric acid bath. The anodic oxidation treatment in the sulfuric acid bath is preferably performed on the following condition: the concentration of sulfuric acid of 100 to 200 g/l, the concentration of aluminum ions of 1 to 10 g/l, the temperature of the solution of 20° C., and the voltage to be applied of approximately 20 V. The average thickness of the anodic oxidation coating on aluminum is usually preferably 20 μm or less, and more preferably 10 μm or less.

Intermediate Layer

The intermediate layer has a function to transport electrons generated in the photosensitive layer to the conductive support side (the electron transport function) and a function to prevent holes from being injected from the conductive support to the photosensitive layer (blocking function). Such an intermediate layer comprises metal oxide particles which is surface-treated with a specific titanium chelate compound, and a binder resin in which the metal oxide particles are dispersed.

Metal oxide particles used as a raw material comprise an N-type semiconductive metal oxide; specifically, a metal oxide having electron transportability but no hole transportability. Examples of such a metal oxide include titanium oxide, zinc oxide, aluminum oxide, aluminum hydroxide, and tin oxides. Among these, preferable are titanium oxide and zinc oxide, and more preferable is titanium oxide in order to increase conductivity and dispersibility.

The crystal form of titanium oxide that forms the metal oxide particles may be any of anatase, rutile and amorphous forms. Preferred is rutile form in order to increase dispersibility. The crystal form of titanium oxide may be a mixture of two or more crystal forms.

The shape of the metal oxide particles used as a raw material may be any of a branched shape, a needle-like shape, and a granular shape; preferred is a granular shape in order to increase the dispersibility of the metal oxide particles in the intermediate layer.

The number average primary particle size of the metal oxide particles used as a raw material is preferably 10 to 400 nm, more preferably 10 to 200 nm, still more preferably 10 to 50 nm, and further still more preferably 10 to 40 nm. If the number average primary particle size of the metal oxide particles is less than 10 nm, the effect of suppressing moire by the intermediate layer may be reduced. On the other hand, if the number average primary particle size of the metal oxide particles is more than 400 nm, the metal oxide particles may be easily sedimented in a coating liquid for an intermediate layer. Namely, the dispersibility is reduced, and therefore, image defects such as dots are easily produced.

The average primary particle size of the metal oxide particles can be determined as follows. Specifically, a transmission electron microscope (TEM) image of the metal oxide particles used as a raw material is observed at a magnification of ×10,000, 100 particles are selected at random as primary particles. The average size of each of these 100 primary particles in the Feret's direction is obtained on the basis of measurement by image analysis. Then, the average value of the obtained 100 values can be determined as the "average primary particle size."

The metal oxide particles are surface treated with a specific titanium chelate compound as described above. The specific titanium chelate compound is a titanium chelate compound represented by the formula (1):

$$Ti(OR)_n(L)_{4-n} \quad (1)$$

In the formula (1), R at each occurrence independently represents a $C_{1-16}$ aliphatic hydrocarbon group. Examples of the aliphatic hydrocarbon group include methyl group, ethyl group, propyl group, isopropyl group, butyl group, pentyl group, hexyl group, octyl group, and tertiary butyl group. Preferable are isopropyl group, ethyl group, hexyl group, and octyl group. If n is 2 or more in the formula (1), two Rs may be coupled to each other. For example, when n is 2, two ORs may be coupled to each other to form an alkylene dioxy group (for example, propane dioxy group).

In the formula (1), L is a ligand derived from a chelating agent. The chelating agent is selected from the group consisting of β-ketoester represented by following formula (1a), β-diketone represented by following formula (1b), and $C_{3-10}$ alkylene glycols.

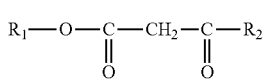

(1a)

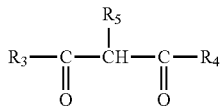

(1b)

In the formula (1a), $R_1$ and $R_2$ each represent a $C_{1-18}$ aliphatic hydrocarbon group. Examples of the aliphatic hydrocarbon group include methyl group, ethyl group, isopropyl group, hexyl group, and octyl group.

Examples of the β-ketoester represented by the formula (1a) include methyl acetoacetate, ethyl acetoacetate, propyl acetoacetate, and butyl acetoacetate.

In the formula (1b), $R_3$ to $R_5$ each may be a $C_{1-18}$ aliphatic hydrocarbon group. In the formula (1b), $R_3$ to $R_5$ are defined same as $R_1$ and $R_2$ in the formula (1a).

Examples of the β-diketone represented by the formula (1b) include acetylacetone, 2,4-heptanedioneethylacetylacetone, diethylacetylacetone, benzoylacetone, hexafluoroacetylacetone, thenoyltrifluoroacetone, and 1,3-cyclohexanedione.

Examples of the $C_{3-10}$ alkylene glycols include propylene glycol, butylene glycol, pentylene glycol, hexylene glycol, octylene glycol, nonamethylene glycol, and decamethylene glycol.

In the formula (1), n is an integer of 1 to 3. In the formula (1), the number of the OR group is preferably smaller, and n is preferably 2 or less. In the formula (1), L is preferably a $C_{3-10}$ alkylene glycol.

Preferred examples of the titanium chelate compound represented by the formula (1) include diisopropoxytitanium bis(methyl acetoacetate), isopropoxytitanium tri(methyl acetoacetate), tributoxytitanium acetylacetonate, dibutoxytitanium bis(ethyl acetoacetonate), dioctyloxytitanium bis(octylene glycolate), diisopropoxytitanium bis(ethyl acetoacetate), propane dioxytitanium bis(ethyl acetoacetate), and diisopropoxytitanium bis(acetylacetonate). Examples of commercial products of the titanium chelate compound represented by the formula (1) include TC-200 (made by Matsumoto Fine Chemical Co., Ltd.), TC-100 (made by Matsumoto Fine Chemical Co., Ltd.), TC-750 (made by Matsumoto Fine Chemical Co., Ltd.), and T-60 (made by NIPPON SODA CO., LTD.).

Although the reason remains still unclear why the metal oxide particles surface treated with the titanium chelate compound represented by the formula (1) demonstrate excellent properties, it is presumed as follows. Namely, the titanium chelate compound represented by the formula (1) mildly undergoes a condensation reaction. For this, uneven progress of the reaction does not occur, and as a result, the surfaces of the metal oxide particles can be uniformly coated. This can suppress unnecessary injection of holes and leakage of thermally excited carriers without reducing the electron transportability.

In order not to impair the electron transportability of the metal oxide particles, the amount of the titanium chelate compound represented by the formula (1) to be applied to the metal oxide particles used as a raw material is preferably 20 wt % or less, and more preferably 15 wt % or less based on the amount of the metal oxide particles used as a raw material. In order to suppress fogging caused by the metal oxide particles, the amount of the titanium chelate compound represented by the formula (1) to be applied is preferably 2 wt % or more, and more preferably 5 wt % or more based on the amount of the metal oxide particles used as a raw material.

The amount of the titanium chelate compound represented by the formula (1) to be applied can be determined from the decrement of the mass of the surface treated metal oxide particles in an ignition loss test on the surface treated metal oxide particles. The ignition loss test can be performed, for example, by heating at 700 to 800° C. using an electric muffle furnace.

The surface treatment with the titanium chelate compound represented by the formula (1) can be performed as follows: for example, the titanium chelate compound represented by the formula (1) and the metal oxide particles are dispersed in a solvent to prepare a liquid, and the liquid is mixed with stirring at a predetermined temperature; then, the solvent is removed from the liquid, and the obtained metal oxide particles are annealed. The annealing means that the metal oxide particles separated by removing the solvent from the liquid are stirred at a predetermined temperature, and heat is applied to the metal oxide particles to complete the reaction.

The amount of the titanium chelate compound represented by the formula (1) to be used for the surface treatment and the temperature and time in mixing and stirring are preferably adjusted in order to preferably provide compatibility between the electron transportability of the metal oxide particles and suppression of fogging.

The amount of the titanium chelate compound represented by the formula (1) to be used for the surface treatment (the amount of the titanium chelate compound represented by the formula (1) to be prepared) is preferably 2 to 20 wt %, and more preferably 5 to 15 wt % based on the amount of the metal oxide particles. If the amount of the titanium chelate compound represented by the formula (1) to be used for the surface treatment is less than 2 wt %, fogging caused by the metal oxide particles may not be sufficiently suppressed, and the blocking property may be insufficient. If the amount of the titanium chelate compound represented by the formula (1) to be used for the surface treatment is more than 20 wt %, the electron transportability of the metal oxide particles may be reduced.

The temperature in mixing and stirring of the liquid is preferably approximately 30 to 150° C., and the mixing and stirring time of the liquid is preferably 0.5 to 10 hours. The annealing temperature can be 120 to 220° C., for example.

When necessary, the metal oxide particles used as a raw material may be further surface treated with other surface treating agents than the titanium chelate compound represented by the formula (1). Namely, the surfaces of the metal oxide particles may be coated with a plurality of layers, and at least one layer of the plurality of layers may be a layer comprising the titanium chelate compound.

Preferred examples of the other treatment agents include inorganic compounds and reactive organic silicon compounds. Examples of the inorganic compounds include alumina, silica, zirconia, and hydrates thereof. Examples of the reactive organic silicon compounds include alkoxysilanes such as methyltrimethoxysilane, n-butyltrimethoxysilane, n-hexyltrimethoxysilane, and dimethyldimethoxysilane; and methylhydrogenpolysiloxane.

In order to increase the dispersibility of the metal oxide particles, preferably, the metal oxide particles are surface treated with the titanium chelate compound, and further surface treated with the reactive organic silicon compound. Such metal oxide particles have the layer of the reactive organic silicon compound as the outermost layer, which efficiently increases the dispersibility of the metal oxide particles.

The metal oxide particles can be surface treated with the other treatment agents by a known method. For example, the surface treatment with the reactive organic silicon compound can be performed as follows: 1) the metal oxide particles are added to a liquid prepared by dispersing the reactive organic silicon compound in water or an organic solvent, and the liquid is mixed with stirring, and 2) the obtained liquid is filtrated, and the obtained metal oxide particles are dried, for example.

Examples of the binder resin contained in the intermediate layer include polyamide resins, vinyl chloride resins, and vinyl acetate resins. Among these, preferable are polyamide resins, and more preferable are alcohol-soluble polyamides such as methoxymethylolated polyamides from the viewpoint of suppressing dissolution of the intermediate layer when the photosensitive layer is applied thereon.

The volume ratio of the metal oxide particles (P) surface-treated with the titanium chelate compound represented by the formula (1) to the binder resin (B) (surface-treated metal oxide particles (P)/binder resin (B)) is preferably 0.4 to 1.6, and more preferably 0.6 to 1.2. When the volume ratio is less than 0.4, the electron transportability of the intermediate layer may be excessively low; therefore, unevenness in image density may be easily produced. On the other hand, when the volume ratio is more than 1.6, the electron transportability of the intermediate layer may be excessively high; therefore, the blocking property is likely to worsen, causing image defects.

The volume ratio of the metal oxide particles (P) surface-treated with the titanium chelate compound represented by the formula (1) to the binder resin (B) can be measured using a TGA (Thermogravimetric Analyzer) according to the following method.

i) The specific gravity of the surface-treated metal oxide particles is measured using a true specific gravity measuring apparatus (micropycnometer) made by Estec Inc. The specific gravity of the binder resin is determined as follows: the weight of the binder resin in a molded piece is measured, the molded piece is put into water whose volume is known, and the excluded volume of water is measured.

ii) Meanwhile, a mixture of the surface-treated metal oxide particles and the binder resin is prepared as a sample to be measured. Next, 5 mg of the sample to be measured is weighed and placed in an aluminum sample pan. Using a simultaneous thermogravimetry and differential thermal analyzer TG/DTA6200 (made by Seiko Instruments Inc.), the weight loss of the sample is measured under a nitrogen gas atmosphere (the amount of the nitrogen gas to be introduced: 150 to 200 ml/min) at a temperature raising rate of 20° C./min as a thermogravimetric curve. The weight of the binder resin is determined from the first weight loss in the thermogravimetric curve, and the weight of the surface-treated metal oxide particles is determined from the remaining weight at that point of time.

iii) Then, from the specific gravity obtained in i) and the weight obtained in ii) of the surface-treated metal oxide particles and those of the binder resin, the volume of the surface-treated metal oxide particles and that of the binder resin are calculated. Thus, the volume ratio (P/B) is calculated.

The film thickness of the intermediate layer is preferably 0.5 to 15 μn, and more preferably 1 to 7 μm. If the film thickness of the intermediate layer is excessively small, not all the surface of the conductive support can be coated, and injection of holes from the conductive support may not be sufficiently blocked. On the other hand, an excessively large film thickness of the intermediate layer increases electric resistance, and sufficient electron transportability may not be provided.

Photosensitive Layer

The photosensitive layer has a function to generate charges by light exposure and a function to transport the generated charges to the surface of the photoconductor. Such a photosensitive layer may have a single layer structure in which the same single layer performs the charge generating function and the charge transport function, or a laminate structure in which one layer performs the charge generating function and another layer performs the charge transport function. Preferably, in order to suppress increase in the remaining potential caused by repeated use of the electrophotographic photoconductor, the photosensitive layer has a laminate structure composed of the charge generation layer and the charge transport layer. The electrophotographic photoconductor for negative charging preferably has a charge generation layer (CGL) provided on the intermediate layer and a charge transport layer (CTL) provided on the charge generation layer.

Charge Generation Layer (CGL)

The charge generation layer has a function to generate charges by light exposure. Such a charge generation layer usually comprises a charge generation material (CGM) and a binder resin in which the charge generation material is dispersed.

The charge generation material can be phthalocyanine pigments, azo pigments, perylene pigments, and azulenium pigments. The charge generation material may be selected depending on the sensitivity to light with the wavelength of exposure light. Preferred are phthalocyanine pigments in order to increase the sensitivity to light with the wavelength of exposure light in a digital image forming apparatus.

For higher sensitivity, preferred phthalocyanine pigments include a Type Y phthalocyanine pigment and a pigment of an adduct of butanediol and titanyl phthalocyanine.

The Type Y phthalocyanine pigment has the largest diffraction peak at a Bragg angle (2θ±0.2°) of 27.3° in an X-ray diffraction spectrum using Cu—Kα radiation.

Examples of the pigment of an adduct of butanediol and titanyl phthalocyanine include a pigment of an adduct of 2,3-butanediol and titanyl phthalocyanine. The pigment of an adduct of 2,3-butanediol and titanyl phthalocyanine is represented by the following formula. In the following formula, "Pc Ring" means a phthalocyanine ring.

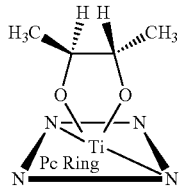

The pigment of an adduct of 2,3-butanediol and titanyl phthalocyanine can have different crystal forms according to the ratio of butanediol to be added. In order to obtain high sensitivity, preferred is a crystal form of an adduct of 2,3-butanediol and titanyl phthalocyanine obtained by reacting 1 mol or less of a butanediol compound with 1 mol of titanyl phthalocyanine. The pigment of the adduct of 2,3-butanediol and titanyl phthalocyanine having such a crystal form has a characteristic peak at a Bragg angle (2θ±0.2°) of at least 8.3° in a powder X ray diffraction spectrum. The pigment of the adduct of 2,3-butanediol and titanyl phthalocyanine has peaks at 24.7°, 25.1°, and 26.5° as well as 8.3°.

The pigment of an adduct of butanediol and titanyl phthalocyanine may be used alone, or may be used as a mixture with a pigment of a non-adduct form of titanyl phthalocyanine.

Particularly preferably, the charge generation layer comprises a pigment of (a non-adduct form of) titanyl phthalocyanine and the pigment of the adduct of 2,3-butanediol and titanyl phthalocyanine. In the photosensitive layer, the ratio of the absorbance at a wavelength of 780 nm, Abs (780), to the absorbance at a wavelength of 700 nm, Abs (700), (Abs (780)/Abs (700)) is preferably 0.8 to 1.1, the absorbance Abs (780) and the absorbance Abs (700) being obtained by conversion from a relative reflectance spectrum of the photoconductor including the photosensitive layer comprising these pigments.

The ratio of absorbance Abs (780) to the absorbance Abs (700) in the photosensitive layer can be determined as follows.

1) First, a sample of a photoconductor is prepared, in which a photosensitive layer comprising a pigment (a non-adduct form of) titanyl phthalocyanine and the pigment of an adduct of 2,3-butanediol and titanyl phthalocyanine is formed on an aluminum support. Then, an absorbance spectrum of the relative reflected light in the sample of the photoconductor is measured. The absorbance spectrum of the reflected light can be measured using an optical film thickness measurement apparatus Solid Lambda Thickness (made by Spectra Co-op). Specifically, the reflection intensity of the aluminum support at each wavelength is measured as a base line. Next, the reflection intensity of the sample of the photoconductor at each wavelength is measured. Then, the reflection intensity of the sample of the photoconductor at the wavelength is divided by the reflection intensity of the aluminum support at the wavelength, and the obtained value is defined as the "relative reflectance ($R_\lambda$)." Thus, the relative reflectance spectrum is obtained.

2) Next, the obtained relative reflectance spectrum of the sample of the photoconductor is converted to the absorbance spectrum by the following equation:

$$Abs\lambda=-\log(R_\lambda)$$

(wherein $R_\lambda$ represents a relative reflectance obtained by dividing the reflection intensity of the sample of the photoconductor at a wavelength λ by the reflection intensity of the aluminum support at the wavelength λ).

3) Next, in order to remove depressions and projections caused by interference fringes, the absorbance spectrum data obtained by conversion in 2) is approximated to a quadratic polynomial in the wavelength range of 765 to 795 nm and in the wavelength range of 685 to 715 nm.

4) Then, in the approximated quadratic polynomial, the absorbance at a wavelength of 780 nm, Abs (780), and the absorbance at a wavelength of 700 nm, Abs (700) are determined. Thus, the ratio of the absorbance Abs (780) to the absorbance Abs (700) (Abs (780)/Abs (700)) is calculated.

The binder resin is not particularly limited, and can be formal resins, butyral resins, silicone resins, silicone-modified butyral resins, and phenoxy resins, for example. These binder resins can reduce increase in the remaining potential accompanied by repeated use of the electrophotographic photoconductor.

The content of the charge generation material is preferably 20 to 600 weight parts, and more preferably 50 to 500 weight parts based on 100 weight parts of the binder resin. When the amount of the charge generation material is less than 20 weight parts, charges cannot be sufficiently generated by light exposure, leading to a reduced sensitivity of the photosensitive layer. When the amount of the charge generation material is more than 600 weight parts, the photosensitive layer may have an excessively high sensitivity. Accordingly, the remaining potential accompanied by repeated use of the electrophotographic photoconductor is likely to be increased.

In the photosensitive layer comprising the pigment of an adduct of butanediol and titanyl phthalocyanine, the ratio of the absorbance at a wavelength of 780 nm, Abs (780), to the absorbance at a wavelength of 700 nm, Abs (700), (Abs (780)/Abs (700)) is preferably 0.8 to 1.1, the ratio being obtained by conversion from the relative reflectance spectrum of the photoconductor including the photosensitive layer comprising the pigment of an adduct of butanediol and titanyl phthalocyanine. If the absorbance ratio Abs (780)/Abs (700) of the photosensitive layer comprising the pigment of an adduct of butanediol and titanyl phthalocyanine is 0.8 to 1.1, the crystal of the pigment is easily stabilized by proper dispersion share, and photosensitivity and image properties by repeated light exposure are stabilized. The absorbance ratio of the photosensitive layer comprising the pigment of an adduct of butanediol and titanyl phthalocyanine can be measured in the same manner as above.

The film thickness of the charge generation layer is not particularly limited. In order to increase the sensitivity, the film thickness is preferably thinner, preferably 0.01 to 5 μm, and more preferably 0.1 to 2 μm.

Charge Transport Layer (CTL)

The charge transport layer has a function to transport the charges generated in the charge generation layer to the surface of the photoconductor. The charge transport layer may be composed of a single layer or two or more layers. The charge transport layer usually comprises a charge transport material (CTM) and a binder resin in which the charge transport material is dispersed.

The charge transport material (CTM) can be triphenylamine derivatives, hydrazone compounds, styryl compounds, benzidine compounds, and butadiene compounds.

The binder resin may be a thermoplastic resin or a thermosetting resin. Examples of the binder resin include polyester resins, polystyrenes, (meth)acrylic resins, vinyl chloride resins, vinyl acetate resins, polyvinyl butyral resins, epoxy resins, polyurethane resins, phenol resins, alkyd resins, polycarbonate resins, silicone resins, and melamine resins. Among these, preferred are polycarbonate resins because they have low water absorbance and can disperse the charge transport material well.

The charge transport layer may further comprise other additives when necessary. Examples of such additives include antioxidants.

The amount of the charge transport material is preferably 10 to 200 weight parts, and more preferably 20 to 100 weight parts based on 100 weight parts of the binder resin. When the amount of the charge transport material is less than 10 weight parts, the charge transportability may be insufficient, and the charges generated in the charge generation layer may not be sufficiently transported to the surface of the photoconductor. On the other hand, when the amount of the charge transport material is more than 200 weight parts, the remaining potential accompanied by repeated use of the electrophotographic photoconductor tends to be remarkably increased.

The film thickness of the charge transport layer is not particularly limited, and can be approximately 10 to 40 μm.

Over Coat Layer (OCL)

The electrophotographic photoconductor according to the present invention may include an over coat layer when necessary. The over coat layer may comprise a binder resin and inorganic fine particles, and may further comprise an antioxidant and a lubricant when necessary. The over coat layer may be formed by applying a coating liquid comprising the binder resin and the inorganic fine particles onto the charge transport layer.

As the inorganic fine particles contained in the over coat layer, fine particles of silica, alumina, strontium titanate, zinc oxide, titanium oxide, tin oxide, antimony oxide, indium oxide, bismuth oxide, indium oxide doped with tin, tin oxide doped with antimony or tantalum, and zirconium oxide can be preferably used. Particularly preferred are hydrophobic silica, hydrophobic alumina, hydrophobic zirconia, and sintered silica fine powder, whose surfaces are hydrophobized.

The number average primary particle size of the inorganic fine particles is preferably 1 to 300 nm, and particularly preferably 5 to 100 nm. The number average primary particle size of the inorganic fine particles is a value obtained by observing 300 particles selected at random as primary particles with a transmission electron microscope at a magnification of ×10,000, and calculating the average of the Feret's diameters from measured values obtained by image analysis.

The binder resin contained in the over coat layer may be a thermoplastic resin or a thermosetting resin. Examples of the binder resin can include polyvinyl butyral resins, epoxy resins, polyurethane resins, phenol resins, polyester resins, alkyd resins, polycarbonate resins, silicone resins, and melamine resins.

Examples of the lubricant contained in the over coat layer include resin fine powders (such as fine powders of fluorine resins, polyolefin resins, silicone resins, melamine resins, urea resins, acrylic resins, and styrene resins), metal oxide fine powders (such as fine powders of titanium oxide, aluminum oxide, and tin oxide), solid lubricants (such as polytetrafluoroethylene, polychlorotrifluoroethylene, polyvinylidene fluoride, zinc stearate, and aluminum stearate), silicone oils (such as dimethyl silicone oil, methylphenylsilicone oil, methylhydrogenpolysiloxane, cyclic dimethylpolysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxyl-modified silicone oil, and higher fatty acid-modified silicone oil), fluorine resin powders (such as tetrafluoroethylene resin powder, chlorotrifluoroethylene resin powder, hexafluoroethylenepropylene resin powder, vinyl fluoride resin powder, vinylidene fluoride resin powder, dichlolofluoroethylene resin powder, and copolymers thereof), polyolefin resin powders (such as homopolymer resin powders such as polyethylene resin powder, polypropylene resin powder, polybutene resin powder, and polyhexene resin powder; copolymer resin powders of ethylene-propylene copolymers and ethylene-butene copolymers; ternary copolymers of these and hexene; and polyolefin resin powders such as powders of thermally modified product thereof).

The molecular weight of the resin used as the lubricant and the particle size of the powder can be properly selected. The particle size of the resin is particularly preferably 0.1 μm to 10 μm. In order to uniformly disperse these lubricants, a dispersant may be further added to the binder resin.

FIG. 1 is a drawing showing an example of a layer configuration in a negative charge type laminated electrophotographic photoconductor. As shown in FIG. 1, a negative charge type laminated electrophotographic photoconductor 10 includes conductive support 12, intermediate layer 14, charge generation layer 16, and charge transport layer 18, which are laminated in this order.

When negative charge type laminated electrophotographic photoconductor 10 is irradiated with light, charges are generated in charge generation layer 16. Of the charges generated in charge generation layer 16, electrons move via intermediate layer 14 to conductive support 12. Holes move via charge transport layer 18 to the surface of the photoconductor to cancel the negative charges on the surface of the photoconductor. Thus, an electrostatic latent image is formed on the surface of the photoconductor.

In the present invention, the surfaces of the metal oxide particles contained in intermediate layer 14 are surface-treated with the titanium chelate compound represented by the formula (1). Thereby, injection of the holes from conductive support 12 can be effectively suppressed, and transport of the electrons thermally excited in charge generation layer 16 can be suppressed. Hence, image defects such as dots and fogging caused by change of the surface potential of the photoconductor can be suppressed. Moreover, the metal oxide particles surface-treated with the titanium chelate compound represented by the formula (1) can ensure sufficient electron transportability. Thereby, unevenness in image density caused by the potential increased after light exposure can be suppressed.

2. Method for Producing Electrophotographic Photoconductor

The electrophotographic photoconductor according to the present invention can be produced, for example, according to: a step of applying a coating liquid for an intermediate layer onto a conductive support and drying the coating liquid to form an intermediate layer, and a step of applying a coating liquid for a photosensitive layer onto the intermediate layer and drying the coating liquid to form a photosensitive layer.

The coating liquid for an intermediate layer comprises the metal oxide particles surface-treated with the titanium chelate compound represented by the formula (1), the binder resin, and a dispersion solvent for dispersing these.

The dispersion solvent contained in the coating liquid for an intermediate layer is preferably a $C_{2-4}$ alcohol such as ethanol, n-propyl alcohol or isopropyl alcohol for their high dissolving power for polyamide resins. These dispersion solvents may be used alone, or may be used in combination with a cosolvent. The amount of these dispersion solvents is 30 to 100 wt %, preferably 40 to 100 wt %, and more preferably 50 to 100 wt % based on the total amount of the solvents. Examples of a cosolvent include methanol, benzyl alcohol, toluene, methylene chloride, cyclohexanone, and tetrahydrofuran.

The coating liquid for a photosensitive layer comprises the charge generation material or the charge transport material, the binder resin, and a dispersion solvent for dispersing these or a dissolution solvent for dissolving these.

Examples of the dispersion solvent or dissolution solvent contained in the coating liquid for a photosensitive layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethyl sulfoxide, and methyl cellosolve. Among these, preferred are methyl ethyl ketone, cyclohexanone, toluene, and tetrahydrofuran.

As a method for applying a variety of coating liquids (for example, the coating liquid for an intermediate layer and the coating liquid for a photosensitive layer) to produce the electrophotographic photoconductor according to the present invention, coating methods such as dip coating, a coating method using a slide hopper type coater, and spray coating can be used. The coating method using a slide hopper type coater is described in detail, for example, in Japanese Patent Application Laid-Open No. 58-189061.

3. Image Forming Apparatus

Figure 2:
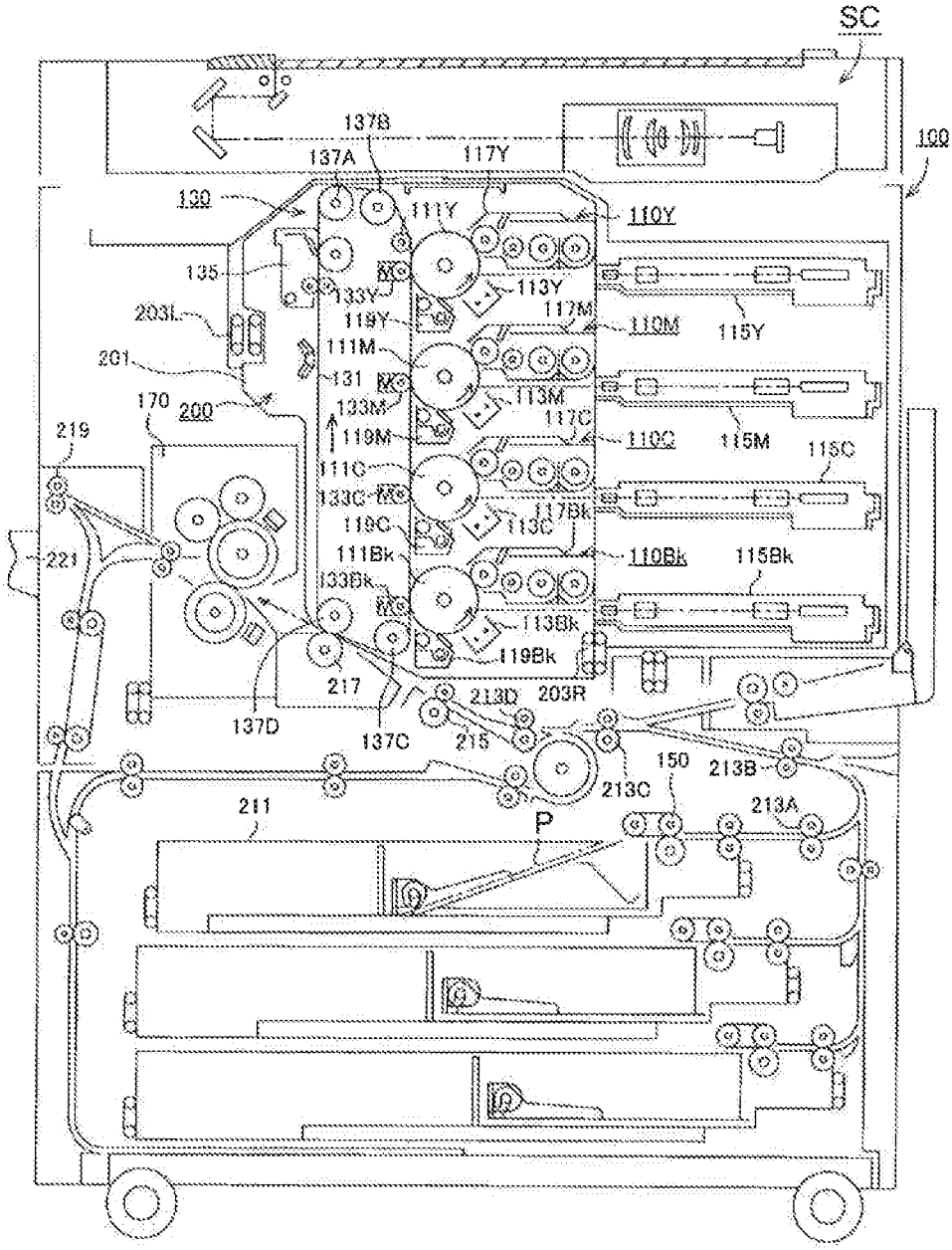
FIG. 2 shows an example of a configuration of an image forming apparatus according to the present invention.

An image forming apparatus according to the present invention includes at least the electrophotographic photoconductor. FIG. 2 is a sectional view showing a configuration of a tandem color image forming apparatus according to the present embodiment. As shown in FIG. 2, image forming apparatus 100 includes 4 image forming units 110Y, 110M, 110C, and 110Bk, endless belt type intermediate transfer member unit 130 (hereinafter, also referred to as "intermediate transfer belt unit 130"), sheet feeding unit 150, and fixing unit 170. Original image reader SC is disposed on the upper portion of main body A of image forming apparatus 100.

Image forming units 110Y, 110M, 110C, and 110Bk are vertically arranged side by side. Image forming unit 110Y includes photoconductor drum 111Y as a first image bearing member; and charging unit 113Y, light exposing unit 115Y, developing unit 117Y, and cleaning unit 119Y, which are sequentially disposed around the circumference of the photoconductor drum in the rotating direction of the drum. Image forming unit 110M includes photoconductor drum 111M as a first image bearing member; and charging unit 113M, light exposing unit 115M, developing unit 117M, and cleaning unit 119M, which are sequentially disposed on the circumference of the photoconductor drum in the rotating direction of the drum. Image forming unit 110C includes photoconductor drum 111C as a first image bearing member; and charging unit 113C; light exposing unit 115C, developing unit 117C, and cleaning unit 119C, which are sequentially disposed on the circumference of the photoconductor drum in the rotating direction of the drum. Image forming unit 110Bk includes photoconductor drum 111Bk as a first image bearing member; and charging unit 113Bk, light exposing unit 115Bk, developing unit 117Bk, and cleaning unit 119Bk, which are sequentially disposed on the circumference of the photoconductor drum in the rotating direction of the drum. Thereby, toner images of yellow (Y), magenta (M), cyan (C), and black (Bk) can be formed on photoconductor drums 111Y, 111M, 111C, and 111Bk, respectively. Thus, image forming units 110Y, 110M, 110C, and 110Bk have the same configuration except that the toner images formed on photoconductor drums 111Y, 111M, 111C, and 111Bk have different colors. Accordingly, by way of one example, image forming unit 110Y will be described below.

Charging unit 113Y evenly applies a potential to photoconductor drum 111Y. In the present embodiment, a corona charger is preferably used as charging unit 113Y.

Light exposing unit 115Y has a function to light-expose photoconductor drum 111Y, to which the potential has been evenly applied by charging unit 113Y, based on an image signal (image signal for yellow) to form an electrostatic latent image corresponding to the yellow image. Light exposing unit 115Y can be composed of LEDs having light-emitting elements arranged in an array in the axial direction of photoconductor drum 111Y and an imaging element, or can be a laser optical system.

A light source for exposure is preferably a semiconductor laser or light-emitting diode having an emission wavelength of 350 to 800 nm. Using these light sources for exposure to reduce the light exposure dot diameter in the main scan direction in writing to 10 to 100 μm, then digitally light-exposing the photoconductor, an electrophotographic image having a high resolution of 600 dpi (dpi: the number of dots per 2.54 cm) to 2400 dpi or more can be formed.

The light-exposure dot diameter represents the largest length (Ld) of a region where the intensity of the light exposure beam is $1/e^2$ or more of the peak intensity, in the main scan direction of a light exposure beam.

Developing unit 117Y is configured to feed a toner to photoconductor drum 111Y and develop the electrostatic latent image formed on the surface of photoconductor drum 111Y. Cleaning unit 119Y can include a roller or a blade in press contact with the surface of photoconductor drum 111Y.

Intermediate transfer belt unit 130 is provided such that the unit can contact photoconductor drums 111Y, 111M, 111C, and 111Bk. Intermediate transfer belt unit 130 includes endless belt type intermediate transfer member 131 (hereinafter, also referred to as "intermediate transfer belt 131") as a second image bearing member; primary transfer rollers 133Y, 133M, 133C, and 133Bk disposed in contact with intermediate transfer belt 131; and cleaning unit 135 for intermediate transfer belt 131.

Intermediate transfer belt 131 is wound around a plurality of rollers 137A, 137B, 137C, and 137D, and rotatably supported by the plurality of rollers 137A, 137B, 137C, and 137D.

In image forming apparatus 100 according to the present embodiment, photoconductor drum 111Y, developing unit 117Y, and cleaning unit 119Y described above may constitute an integrally formed process cartridge (image forming unit) detachably mountable on the main body of the apparatus. Alternatively, one or more members selected from the group consisting of charging unit 113Y, light exposing unit 115Y, developing unit 117Y, primary transfer roller 133Y, and cleaning unit 119Y may be integrated with photoconductor drum 111Y to constitute a process cartridge (image forming unit).

Process cartridge 200 in FIG. 2 includes casing 201; photoconductor drum 111Y, charging unit 113Y, developing unit 117Y, and cleaning unit 119Y accommodated in casing 201; and intermediate transfer belt unit 130. The main body of the apparatus has support rails 203L and 203R as a unit for guiding process cartridge 200 into the main body of the apparatus. Thereby, process cartridge 200 can be detachably mounted on the main body of the apparatus. Process cartridge 200 can be a single image forming unit detachably mountable on the main body of the apparatus.

Sheet feeding unit 150 is provided to convey toner receiving article P in sheet feeding cassette 211 via a plurality of intermediate rollers 213A, 213B, 213C, and 213D and registration roller 215 to secondary transfer roller 217.

Fixing unit 170 fixes a color image transferred by secondary transfer roller 217. Sheet discharging rollers 219 are provided to sandwich toner receiving article P with a fixed color image therebetween and place toner receiving article P onto sheet tray 221 provided in the outside of the image forming apparatus.

Thus-configured image forming apparatus 100 forms an image using image forming units 110Y, 110M, 110C, and 110Bk. Specifically, charging units 113Y, 113M, 113C, and 113Bk negatively charge the surfaces of photoconductor drums 111Y, 111M, 111C, and 111Bk by corona discharging. Next, light exposing units 115Y, 115M, 115C, and 115Bk light-expose the surfaces of photoconductor drums 111Y, 111M, 111C, and 115Bk, respectively, based on the image signal. Thereby, electrostatic latent images corresponding to the respective colors are formed. Next, developing units 117Y, 117M, 117C, and 117Bk feed toner to the surfaces of photoconductor drums 111Y, 111M, 111C, and 111Bk. Thereby, the respective electrostatic latent images are developed.

Next, primary transfer rollers (primary transferring unit) 133Y, 133M, 133C, and 133Bk are brought into contact with rotating intermediate transfer belt 131. Thereby, the images of the respective colors formed on corresponding photoconductor drums 111Y, 111M, 111C, and 111Bk are sequentially transferred onto rotating intermediate transfer belt 131 to transfer (primarily transfer) a color image. During the image forming processing, primary transfer roller 133Bk is kept in contact with photoconductor drum 111Bk. On the other hand, other primary transfer rollers 133Y, 133M, and 133C contact corresponding photoconductor drums 111Y, 111M, and 111C only when the color image is formed.

Then, primary transfer rollers 133Y, 133M, 133C, and 133Bk are separated from intermediate transfer belt 131. The remaining toners on the surfaces of photoconductor drums 111Y, 111M, 111C, and 111Bk are removed by cleaning units 119Y, 119M, 119C, and 119Bk, respectively. For the next image formation, when necessary, each of the surfaces of photoconductor drums 111Y, 111M, 111C, and 111Bk is discharged by a discharging unit (not shown). Subsequently, charging units 113Y, 113M, 113C, and 113Bk negatively charge the surfaces of photoconductor drums 111Y, 111M, 111C, and 111Bk, respectively.

Meanwhile, toner receiving article P accommodated in sheet feeding cassette 211 (for example, a support carrying the final image such as normal paper and transparent sheet) is fed by sheet feeding unit 150, and conveyed via the plurality of intermediate rollers 213A, 213B, 213C, and 213D and registration roller 215 to secondary transfer roller (secondary transferring unit) 217. Secondary transfer roller 217 is brought into contact with rotating intermediate transfer belt 131 to transfer (secondarily transfer) the color image onto toner receiving article P. Secondary transfer roller 217 contacts intermediate transfer belt 131 only during the time of secondary transfer onto toner receiving article P. Subsequently, toner receiving article P having the transferred color image is separated from intermediate transfer belt 131 at a portion thereof having a high curvature.

Transfer material P having the transferred color image as above is subject to fixation by fixing unit 170, then advanced while sandwiched between sheet discharging rollers 219, and placed onto sheet tray 221 in the outside of the apparatus. After toner receiving article P having the transferred color image is separated from intermediate transfer belt 131, the remaining toner on intermediate transfer belt 131 is removed by cleaning unit 135.

In the present embodiment, the transfer medium to which the toner image formed on photoconductor drum 111Y is transferred, such as intermediate transfer belt 131 and toner receiving article P, is collectively referred to as a "recording medium."

As described above, the intermediate layer in photoconductor drums 111Y, 111M, 111C, and 111Bk included in image forming apparatus 100 according to the present embodiment has sufficient electron transportability. For this reason, increase in the remaining potential on the surfaces of photoconductor drums 111Y, 111M, 111C, and 111Bk can be suppressed, and unevenness in image density can be reduced. Further, the intermediate layer in photoconductor drums 111Y, 111M, 111C, and 111Bk included in image forming apparatus 100 has a good blocking property. For this reason, particularly even in photoconductor drums 111Y, 111M, 111C, and 111Bk including the highly sensitive charge generation layer, unnecessary injection of holes from the conductive support and unnecessary movement of thermally excited carriers from the charge generation layer can be reduced, and image defects such as dots and fogging can be prevented.

The image forming apparatus according to the present invention is used as electrophotographic apparatuses such as electrophotographic copiers, laser printers, LED printers, and liquid crystal shutter printers. Further, the image forming apparatus according to the present invention can be widely used for display units, recording apparatuses, quick printers, plate making apparatuses, and fax machines using electrophotographic techniques.

Thus, the present invention can provide an electrophotographic photoconductor including an intermediate layer having sufficient electron transportability and sufficient blocking property, wherein unevenness in image density can be improved and image defects such as fogging and dots can be reduced.

EXAMPLES

Hereinafter, the present invention will be described more in detail with reference to Examples. It should not be interpreted that the scope of the present invention is limited by these Examples.

First, the titanium chelate compounds represented by the formula (1) used in Examples are shown in Table 1.

TABLE 1

Titanium chelate compounds represented by formula (1)

| Trade name | Name of compound |
|---|---|
| TC-200 (made by Matsumoto Fine Chemical Co., Ltd.) | Dioctyloxytitanium bis(octylene glycolate) |
| TC-100 (made by Matsumoto Fine Chemical Co., Ltd.) | Diisopropoxytitanium bis(acetylacetonate) |
| TC-750 (made by Matsumoto Fine Chemical Co., Ltd.) | Diisopropoxytitanium bis(ethyl acetoacetate) |
| T-60 (made by NIPPON SODA CO., LTD.) | Propanedioxytitanium bis(ethyl acetoacetate) |

Example 1

1) Production of Conductive Support

An aluminum alloy tube having a length of 362 mm was mounted on an NC lathe, and subjected to machining by a diamond sintered bit so as to have an outer diameter of 59.95 mm and a surface roughness Rz of 1.2 μm. Then, the tube was washed to obtain a conductive support.

2) Production of Surface-Treated Metal Oxide Particles 1

100 weight parts of rutile titanium oxide having a primary particle size of 35 nm as metal oxide particles and 500 weight parts of toluene were mixed with stirring. 5.5 weight parts of dioctyloxytitanium bis(octylene glycolate) (TC-200, made by Matsumoto Fine Chemical Co., Ltd.) was added as the titanium chelate compound represented by the formula (1), and the liquid was stirred at 80° C. for 2 hours. Subsequently, toluene was removed by distillation at reduced pressure, and the obtained product was baked at 180° C. for 3 hours. Thereby, titanium oxide particles surface-treated with the titanium chelate compound represented by the formula (1) (surface-treated Metal Oxide Particles 1) were obtained. Surface-treated Metal Oxide Particles 1 had a true specific gravity of 3.6.

3) Production of Electrophotographic Photoconductor

Formation of Intermediate Layer 1 weight part of the polyamide resin (N-1) below as the binder resin was added to 20 weight parts of a mixed solvent of ethanol/n-propyl alcohol/tetrahydrofuran (volume ratio of 45/20/35), and the solution was mixed with stirring at 20° C. 4.2 weight parts of surface-treated Metal Oxide Particles 1 were added to the solution, and dispersed by a bead mill at a mill residence time of 3 hours. Then, the solution was left as it was one day and night, and filtered to obtain a coating liquid for an intermediate layer. Filtration was performed under a pressure of 50 kPa using a Rigimesh filter (made by Pall Corporation) having a nominal filtration rating of 5 μm as a filtration filter.

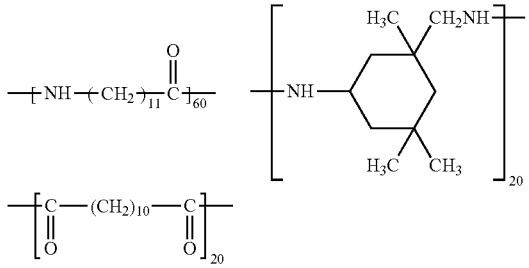

Polymide resin (N-1)

The conductive support was dipped into (coated by dip coating with) the thus-obtained coating liquid for an intermediate layer, and dried at 120° C. for 30 minutes to form an intermediate layer having a thickness of 2 μm on the circumferential surface of the conductive support. In the obtained intermediate layer, the volume ratio P/B of surface-treated Metal Oxide Particles 1 (P) to the binder resin (B) was 1.0.

Formation of Charge Generation Layer

The components below were mixed, and dispersed by a sand mill dispersing machine for 15 hours to prepare a coating liquid for a charge generation layer. The coating liquid for a charge generation layer was applied onto the intermediate layer in the same way as above by dip coating, and dried to form a charge generation layer having a thickness of 0.5 μm.

(Coating Liquid for Charge Generation Layer)

Charge generating material: 20 weight parts of Type Y titanyl phthalocyanine (a titanyl phthalocyanine pigment having the largest diffraction peak at a Bragg angle (2θ±0.2°) of 27.3° in the X-ray diffraction spectrum using Cu—Kα radiation)

Binder resin: 10 weight parts of polyvinyl butyral (BX-1, made by SEKISUI CHEMICAL CO., LTD.)

Dispersion solvent: 700 weight parts of methyl ethyl ketone 300 weight parts of cyclohexanone Formation of Charge Transport Layer The components below were mixed to prepare a coating liquid for a charge transport layer. The coating liquid for a charge transport layer was applied onto the charge generation layer in the same way as above by dip coating, and dried to form a charge transport layer having a thickness of 20 μm. Thus, an electrophotographic photoconductor was obtained.

(Coating Liquid for Charge Transport Layer)

Charge transport material: 225.0 weight parts of the compound below

Binder resin: 300.0 weight parts of polycarbonate Z300 (made by MITSUBISHI GAS CHEMICAL COMPANY, INC.)

Antioxidant: 6.0 weight parts of Irganox 1010 (made by BASF SE)

Dispersion solvent: 2,000.0 weight parts of a tetrahydrofuran/toluene mixed solution (volume ratio of 3/1)

Other additives: 1.0 weight part of silicone oil KF-54 (made by Shin-Etsu Chemical Co., Ltd.)

Charge Transport Material

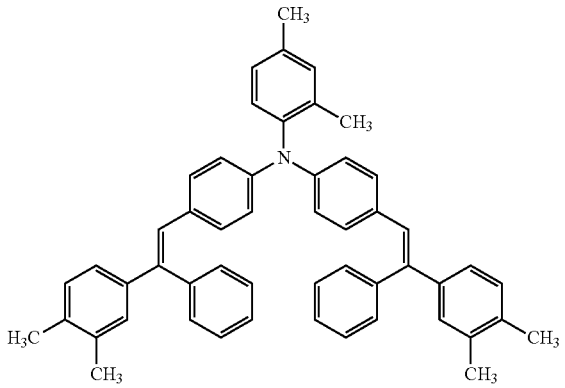

Example 2

Production of Surface-Treated Metal Oxide Particles 2

500 weight parts of surface-treated Metal Oxide Particles 1 obtained in Example 1, 30 weight parts of methylhydrogenpolysiloxane (MHPS), and 1,500 weight parts of toluene were mixed with stirring, and subjected to wet disintegration by a bead mill at a mill residence time of 25 minutes and a temperature of 35±5° C. Toluene was separated and removed from the slurry obtained by the wet disintegration by distillation at a reduced pressure using a kneader (bath temperature: 110° C., product's temperature: 30 to 60° C., degree of reduction of the pressure: approximately 100 Torr). Methylhydrogenpolysiloxane was adhered to the obtained dry product by baking at 120° C. for 2 hours. The powder obtained after baking was cooled to room temperature, and crushed by a pin mill. Thereby, titanium oxide particles surface-treated with the titanium chelate compound represented by the formula (1) and MHPS (surface treated-Metal Oxide Particles 2) were obtained.

Production of Electrophotographic Photoconductor

An electrophotographic photoconductor was produced in the same manner as in Example 1 except that instead of surface-treated Metal Oxide Particles 1, surface-treated Metal Oxide Particles 2 were used in the intermediate layer for the photoconductor.

Example 3

Production of Surface-Treated Metal Oxide Particles 3

Titanium oxide particles surface-treated with the titanium chelate compound represented by the formula (1) were obtained in the same manner as in Example 1 except that the primary particle size of rutile titanium oxide in production of surface-treated Metal Oxide Particles 1 was changed to 15 nm. 500 weight parts of the titanium oxide particles surface-treated, 40 weight parts of MHPS, and 1,500 weight parts of toluene were mixed with stirring. The obtained mixture was subjected to wet disintegration by a bead mill at a mill residence time of 45 minutes and a temperature of 35±5° C. Thus, titanium oxide particles surface-treated with the titanium chelate compound represented by the formula (1) and MHPS (surface-treated Metal Oxide Particles 3) were obtained in the same manner as in Example 2, except for the amount of MHPS and the mill residence time.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 3.

Example 4

Production of Surface-Treated Metal Oxide Particles 4

Titanium oxide particles surface-treated with the titanium chelate compound represented by the formula (1) (surface-treated Metal Oxide Particles 4) were obtained in the same manner as in Example 1 except that rutile titanium oxide particles having a primary particle size of 35 nm in production of surface-treated Metal Oxide Particles 1 were replaced by anatase titanium oxide particles having a primary particle size of 30 nm.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 4.

Example 5

Production of Surface-Treated Metal Oxide Particles 5

Titanium oxide particles surface-treated with the titanium chelate compound represented by the formula (1) and MHPS (surface-treated Metal Oxide Particles 5) were obtained in the same manner as in Example 2 except that surface-treated Metal Oxide Particles 1 used in production of surface-treated Metal Oxide Particles 2 were replaced by surface-treated Metal Oxide Particles 4.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 5.

Examples 6 to 8

Production of Surface-Treated Metal Oxide Particles 6 to 8

Surface treated Metal Oxide Particles 6 to 8 were obtained in the same manner as in Example 1 except that the titanium chelate compound represented by the formula (1) used in production of surface-treated Metal Oxide Particles 1 was replaced as shown in Table 2.

Production of Electrophotographic Photoconductor

An electrophotographic photoconductor was produced in the same manner as in Example 1 except that surface-treated Metal Oxide Particles 1 contained in the intermediate layer of the photoconductor was replaced by each of surface-treated Metal Oxide Particles 6 to 8.

Example 9

Production of Surface-Treated Metal Oxide Particles 9

Surface treated Metal Oxide Particles 9 were obtained in the same manner as in Example 1 except that rutile titanium oxide particles having a primary particle size of 35 nm used in production of surface-treated Metal Oxide Particles 1 were replaced by zinc oxide particles having a primary particle size of 35 nm.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 9.

Example 10

Synthesis of Charge Generation Material CG-1

Crude titanyl phthalocyanine was synthesized from 1,3-diiminoisoindoline and titanium tetra-n-butoxide. The obtained crude titanyl phthalocyanine was dissolved in sulfuric acid to prepare a solution, and the solution was poured into water to deposit crystals. The solution diluted with water was filtered, and the obtained crystals were sufficiently washed with water to obtain a wet paste product. Next, the wet paste product was frozen in a freezer, and then, defrosted, filtered, and dried to obtain amorphous titanyl phthalocyanine.

The obtained amorphous titanyl phthalocyanine and (2R,3R)-2,3-butanediol were mixed in ortho-dichlorobenzene (ODB) such that the equivalent ratio of (2R,3R)-2,3-butanediol to the amorphous titanyl phthalocyanine was 0.6. The obtained mixture was heated and stirred at 60 to 70° C. for 6 hours. After the obtained liquid was left as it was overnight, methanol was further added to deposit crystals. The liquid was filtered, and the obtained crystals were washed with methanol to obtain charge generation material CG-1 containing an adduct of (2R,3R)-2,3-butanediol and titanyl phthalocyanine.

The X ray diffraction spectrum of charge generation substance CG-1 was measured. As a result, it was found that charge generation substance CG-1 had peaks at 8.3°, 24.7°, 25.1°, and 26.5°. It was presumed that the obtained charge generation substance CG-1 was mixed crystals of a 1:1 adduct of titanyl phthalocyanine and (2R,3R)-2,3-butanediol and titanyl phthalocyanine (a non-adduct form).

Production of Electrophotographic Photoconductor

A coating liquid for a charge generation layer was prepared in the same manner as in Example 1 except that the composition of the coating liquid for a charge generation layer was changed as follows, and the coating liquid was dispersed at a circulation flow rate of 40 L/H for 0.5 hours using a circulating ultrasonic homogenizer RUS-600TCVP (made by NIHONSEIKI KAISHA LTD., 19.5 kHz, 600 W). A charge generation layer was formed in the same manner as in Example 1, and an electrophotographic photoconductor was produced.

(Coating Liquid for Charge Generation Layer)

Charge generation material: 24 weight parts of CG-1

Binder resin: 12 weight parts of a polyvinyl butyral resin S-LEC BL-1 (made by SEKISUI CHEMICAL CO., LTD.)

Dispersion solvent: 400 weight parts of a methyl ethyl ketone/cyclohexanone mixed solvent (volume ratio of 4/1)

The relative reflectance spectrum of the photoconductor obtained in Example 10 was measured by the following procedure using an optical film thickness measurement apparatus Solid Lambda Thickness (made by Spectra Co-op).

1) First, the reflection intensity of the aluminum support at each wavelength was measured as a base line. Next, the reflection intensity of the sample of the photoconductor at each wavelength was measured. The reflection intensity of the sample of the photoconductor at the wavelength was divided by the reflection intensity of the aluminum support at the wavelength, and the obtained value was defined as the "relative reflectance ($R_\lambda$)." Thus, the relative reflectance spectrum was obtained.

2) The obtained relative reflectance spectrum of the sample of the photoconductor was converted into the absorbance spectrum by the following equation:

$$Abs\lambda = -\log(R_\lambda)$$

(wherein $R_\lambda$ represents a relative reflectance obtained by dividing the reflection intensity of the sample of the photoconductor at a wavelength λ by the reflection intensity of the aluminum support at the wavelength λ).

3) Next, in order to remove depressions and projections generated by interference fringes, the absorbance spectrum data obtained by conversion in 2) was approximated to a quadratic polynomial in a wavelength range of 765 to 795 nm and in a wavelength range of 685 to 715 nm.

4) In the approximated quadratic polynomial; the absorbance at a wavelength of 780 nm, Abs (780), and the absorbance at a wavelength of 700 nm, Abs (700), were determined, and the absorbance ratio of (Abs (780)/Abs (700)) was calculated. The obtained absorbance ratio (Abs (780)/Abs (700)) was 0.99.

Comparative Example 1

Production of Surface-Treated Metal Oxide Particles 11

Titanium oxide particles surface-treated only with MHPS (surface-treated Metal Oxide Particles 11) were obtained in the same manner as in Example 2 except that surface-treated Metal Oxide Particles 1 in Example 1 used in production of surface-treated Metal Oxide Particles 2 were replaced by rutile titanium oxide particles having a primary particle size of 35 nm, which were not surface-treated.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 11.

Comparative Example 2

Production of Surface-Treated Metal Oxide Particles 12

Titanium oxide particles surface-treated only with MHPS (surface treated-Metal Oxide Particles 12) were obtained in the same manner as in Example 2 except that surface-treated Metal Oxide Particles 1 in Example 1 used in production of surface-treated Metal Oxide Particles 2 were replaced by anatase titanium oxide particles having a primary particle size of 30 nm, which were not surface-treated.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 12.

Comparative Example 3

Production of Surface-Treated Metal Oxide Particles 13

Titanium oxide particles surface-treated with isopropyltriisostearoyl titanate (surface-treated Metal Oxide Particles 13) were obtained in the same manner as in Example 1 except that the titanium chelate compound represented by the formula (1) used in production of surface-treated Metal Oxide Particles 1 was replaced by isopropyltriisostearoyl titanate.

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 13.

Comparative Example 4

Production of Surface-Treated Metal Oxide Particles 14

Titanium oxide particles surface-treated with titanium tetraisopropoxide (surface-treated Metal Oxide Particles 14) were obtained in the same manner as in Example 1 except that the titanium chelate compound represented by the formula (1) used in production of surface-treated Metal Oxide Particles 1 was replaced by titanium tetraisopropoxide (TA-10 made by Matsumoto Fine Chemical Co., Ltd.).

Production of Electrophotographic Photoconductor

An electrophotographic photoconductor was produced in the same manner as in Example 1 except that surface-treated Metal Oxide Particles 1 contained in the intermediate layer of the photoconductor were replaced by surface-treated Metal Oxide Particles 14.

The coating liquids for an intermediate layer obtained in Examples 1 to 10 and Comparative Examples 1 to 4 were evaluated for the dispersibility as follows. Further, the electrophotographic photoconductors obtained in Examples 1 to 10 and Comparative Examples 1 to 4 were evaluated for the surface potential and the image (unevenness in image density, fogging) as follows. The results of the evaluation are shown in Table 2.

Dispersion Stability of Coating Liquid for Intermediate Layer

Each of the obtained coating liquids for an intermediate layer was left as it was in a glass beaker at room temperature for 2 days, then a degree of sedimentation of the surface-treated metal oxide particles was visually observed. Dispersion stability of the coating liquid for an intermediate layer was evaluated according to the following criterion.

○: No particles are sedimented.

Δ: Particles are slightly sedimented, but return to the original state by stirring.

X: Particles are remarkably sedimented, and do not return to the original state by stirring.

Surface Potential of Electrophotographic Photoconductor

Using an electrical properties measurement apparatus, measurement was made for the surface of the obtained electrophotographic photoconductor to obtain the difference between the initial surface potential (at 0 seconds) and the surface potential after 30 seconds at 10° C. and 15% RH (change of the potential ΔVi). The change of the surface potential was measured by repeatedly charging and light-exposing the surface of the electrophotographic photoconductor under the condition of a grid voltage of −800V and a light exposure amount of 0.5 μJ/cm$^2$ while the electrophotographic photoconductor was rotated at 130 rpm. From the viewpoint of suppressing unevenness in image density between pages and within the page, the change of the potential ΔVi is preferably 20V or less.

Evaluation of Image

Using a bizhub PRO C6501 made by Konica Minolta Business Technologies, Inc. (laser exposure, reversal development, a tandem color multifunction machine with an intermediate transfer member), an image was formed at 30° C. and 80% RH, and evaluated. The conditions for evaluation were as follows.

1) Unevenness of Image Density

Figure 3:
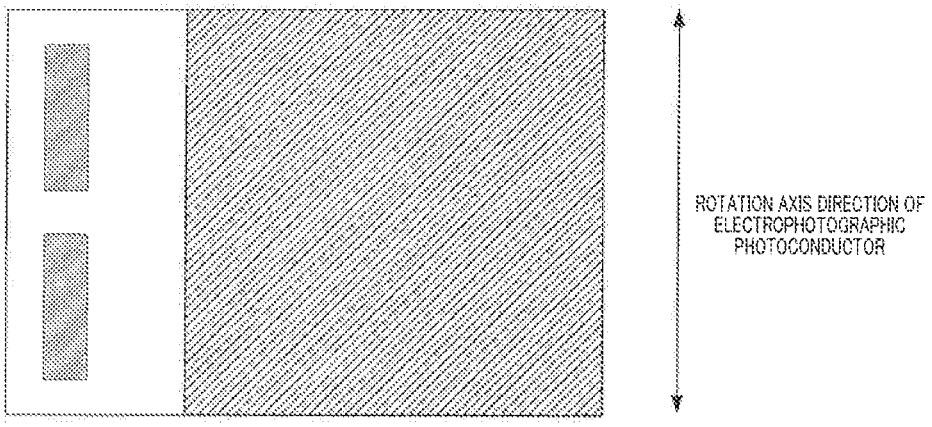
FIG. 3 shows a chart output in Example.

The obtained electrophotographic photoconductor was disposed in a position of black (BK). The transfer current was changed from 20 μA to 100 μA, and a chart shown in FIG. 3 was output. In FIG. 3, a large portion shown by slanted lines represents a halftone image, and two small portions shown by slanted lines each represent a solid image. For a recording paper, a POD Gloss Coat (100 g/m$^2$) of an A3 size made by Oji Paper Co., Ltd. was used. The image formed on the recording paper was visually observed. The unevenness in image density was evaluated according to the following criterion.

◎: At a transfer current of 60 μA or higher, no unevenness in image density is found.

○: At a transfer current of 60 μA or higher, unevenness in image density is slightly found, but the level of the unevenness presents practically no problem.

Δ: At a transfer current of 40 to 50 μA, unevenness in image density is slightly found, but the level of the unevenness presents practically no problem. (However, the level of the unevenness presents problems when a high quality image is formed.)

X: At a transfer current less than 40 μA, unevenness in image density is clearly found, and the level of the unevenness presents problems in practice.

2) Fogging (Sensory Evaluation)

The obtained electrophotographic photoconductor was disposed in a position of black (BK). A recording paper having no image formed thereon (made by Oji Paper Co., Ltd., POD Gloss Coat, 100 g/m$^2$, A3 size) was prepared. The recording paper was conveyed to the position of black, and a blank image (an image at a coverage rate of 0%) was formed under the condition of a grid voltage of −800 V and a developing bias of −650 V. Then, presence of fogging on the obtained recording paper was evaluated.

Similarly, a recording paper having a yellow solid image formed thereon (made by Oji Paper Co., Ltd., POD Gloss Coat, 100 g/m$^2$, A3 size) was prepared instead of the recording paper having no image formed thereon. The recording paper was conveyed to the position of black (BK), and a blank image (a yellow solid image) was formed in the same manner as above. Then, presence of fogging on the obtained recording paper was evaluated. Usually, fogging tends to be transferred on the yellow solid image. Accordingly, use of the yellow solid image can detect the fogging, which is difficult to detect in the blank image. Namely, use of the yellow solid image enables exact evaluation on the fogging.

Presence of the fogging was evaluated according to the following criterion.

A: No fogging.

B: Fogging is slightly found when the image is enlarged, but the level of the fogging presents practically no problem.

C: Fogging is found by visually observation, and the level of the fogging presents a problem in practice (no good).

D: Fogging is remarkably found (no good).

3) Fogging (Evaluation of the Image Density)

In the recording paper after the black (BK) image was formed in 2), the density of the fogging in the portion in which the image was not formed was measured by a Macbeth reflection densitometer (RD-918). Specifically, the measurement was performed according to the following procedure.

1) In a recording paper having no image formed thereon (a white paper), the absolute image density was measured at any 20 places thereof, and the average value of these was defined as the "density of the white paper before formation of an image (IDw)."

2) The obtained electrophotographic photoconductor was disposed in the position of black (BK), and a blank image was formed on the recording paper in 1). The absolute image density was measured at any 20 places in the obtained recording paper, and the average value of these was defined as the "density of the white paper after formation of the blank image (1 Db)."

3) The densities of the white paper determined in 1) and 2) were substituted into the following equation to determine the density of the fogging:

$$\text{density of fogging} = IDb - IDw$$

The density of fogging was evaluated according to the following criterion.

○: Good. The density of fogging is 0.006 or less.

Δ: The density of fogging is greater than 0.006 and 0.01 or less, and the level thereof presents a problem in practice when high quality is demanded.

X: The density of fogging is greater than 0.01, and the level thereof presents a problem in practice.

TABLE 2

| | Intermediate layer | | | | | | Charge generation layer | Properties of electrophotographic photoconductor | | | | |
|---|---|---|---|---|---|---|---|---|---|---|---|---|
| | Surface treated metal oxide particles | | | | | | | | | | | |
| | Metal oxide particles | | | Surface treating agent | | | | | | | | |
| | No | Kind | Primary Particle size (nm) | Titanium chelate compound represented by formula (1) | Others | Coating liquid Dispersibility | Charge generation material Kind | Measurement of potential ΔVi (V) | Evaluation of image: Unevenness of density | Fogging: White | Fogging: Y | Fogging: Density |
| Example 1 | 1 | $TiO_2$ (rutile) | 35 | TC-200 | — | ○ | Y-TiOPc | 16 | ◎ | A | B | ○ |
| Example 2 | 2 | $TiO_2$ (rutile) | 35 | TC-200 | MHPS | ○ | | 18 | ○ | A | A | ○ |
| Example 3 | 3 | $TiO_2$ (rutile) | 15 | TC-200 | MHPS | ○ | | 11 | ◎ | A | A | ○ |
| Example 4 | 4 | $TiO_2$ (anatase) | 30 | TC-200 | — | Δ | | 4 | ◎ | A | B | ○ |
| Example 5 | 5 | $TiO_2$ (anatase) | 30 | TC-200 | MHPS | ○ | | 8 | ◎ | A | B | ○ |
| Example 6 | 3 | $TiO_2$ (rutile) | 35 | TC-100 | — | ○ | | 12 | ◎ | B | B | ○ |
| Example 7 | 7 | $TiO_2$ (rutile) | 35 | TC-750 | — | ○ | | 15 | ◎ | B | B | ○ |
| Example 8 | 5 | $TiO_2$ (rutile) | 35 | T-60 | — | Δ | | 10 | ◎ | B | B | ○ |
| Example 9 | 9 | $ZnO_2$ | 35 | TC-200 | — | Δ | | 20 | ○ | A | B | ○ |
| Example 10 | 10 | $TiO_2$ (rutile) | 35 | TC-200 | — | ○ | CG-1 | 17 | ◎ | A | B | ○ |
| Comparative Example 1 | 11 | $TiO_2$ (rutile) | 35 | — | MHPS | ○ | Y-TiOPc | 15 | ○ | B | C | Δ |
| Comparative Example 2 | 12 | $TiO_2$ (anatase) | 30 | — | MHPS | ○ | | 2 | ◎ | D | D | X |
| Comparative Example 3 | 13 | $TiO_2$ (rutile) | 35 | — | ITT | Δ | | 33 | Δ | C | C | Δ |
| Comparative Example 4 | 14 | $TiO_2$ (rutile) | 35 | — | TT | Δ | | 53 | X | A | A | ○ |

The abbreviated names of the materials in Table 2 represent:
TC-200: dioctyloxytitanium bis(octylene glycolate)
TC-100: diisopropoxytitanium bis(acetylacetonate)
TC-750: diisopropoxytitanium bis(ethyl acetoacetate)
TC-60: propane dioxytitanium bis(ethyl acetoacetate)
MHPS: methylhydrogenpolysiloxane
ITT: isopropyltriisostearoyl titanate
TT: titanium tetraisopropoxide
Y-TiOPc: Type Y titanyl phthalocyanine
CG-1: adduct of butanediol and titanyl phthalocyanine/titanyl phthalocyanine non-adduct As shown in Table 2, the electrophotographic photoconductors in Examples 1 to 10 include the intermediate layer comprising the metal oxide particles surface-treated with the titanium chelate compound represented by the formula (1). The surface potentials ΔVi of the electrophotographic photoconductors in Examples 1 to 10 each are as low as not greater than 20 V. Further, in Examples 1 to 10, both of the unevenness in image density and the fogging are suppressed. Accordingly, it turns out that the electrophotographic photoconductors in Examples 1 to 10 have both of the electron transportability and the blocking property. Further, the coating liquids for an intermediate layer used in Examples 1 to 10 generally have high dispersion stability. Accordingly, in Examples 1 to 10, production of dots is suppressed. On the other hand, in the electrophotographic photoconductors in Comparative Examples 1 to 4 using no metal oxide particles surface-treated with the titanium chelate compound represented by the formula (1), at least one of the unevenness in image density and the fogging cannot be suppressed. For example, it is shown that in the evaluation machine and evaluation conditions used in the present Examples, fogging is produced in the electrophotographic photoconductors in Comparative Examples 1 and 2, although the unevenness in image density is relatively reduced.

INDUSTRIAL APPLICABILITY

The present invention can provide an electrophotographic photoconductor including an intermediate layer having sufficient electron transportability and a sufficient blocking property, wherein both unevenness in image density and image defects such as fogging and dots are reduced.

| Reference Signs List | |
|---|---|
| 10 | Electrophotographic photoconductor |
| 12 | Conductive support |
| 14 | Intermediate layer |
| 16 | Charge generation layer |
| 18 | Charge transport layer |
| 100 | Image forming apparatus |
| 110Y, 110M, 110C, 110Bk | Image forming unit |
| 111Y, 111M, 111C, 111Bk | Photoconductor drum |
| 113Y, 113M, 113C, 113Bk | Charging unit |
| 115Y, 115M, 115C, 115Bk | Light exposing unit |
| 117Y, 117M, 117C, 117Bk | Developing unit |
| 119Y, 119M, 119C, 119Bk | Cleaning unit |
| 130 | Endless belt type intermediate transfer member unit |
| 131 | Endless belt type intermediate transfer member (recording medium) |
| 133Y, 133M, 133C, 133Bk | Primary transfer roller (transferring unit) |
| 135 | Cleaning unit |
| 137A, 137B, 137C, 137D | Roller |
| 150 | Sheet feeding unit |
| 170 | Fixing unit |
| 200 | Process cartridge |
| 201 | Casing |
| 203R, 203L | Support rail |
| 211 | sheet feeding cassette |
| 213A, 213B, 213C, 213D | Intermediate roller |
| 215 | Registration roller |

-continued

| Reference Signs List | |
|---|---|
| 217 | Secondary transfer roller (transferring unit) |
| 219 | Sheet discharging roller |
| 221 | Sheet tray |
| P | Toner receiving material (recording medium) |

The invention claimed is:

1. An electrophotographic photoconductor comprising a conductive support, a photosensitive layer disposed on the conductive support, and an intermediate layer disposed between the conductive support and the photosensitive layer, wherein the intermediate layer comprises metal oxide particles and a binder resin, and the metal oxide particles are surface-treated with a titanium chelate compound represented by the following formula (1):

$$Ti(OR)_n(L)_{4-n} \quad (1)$$

wherein

R at each occurrence independently represents a $C_{1-16}$ aliphatic hydrocarbon group;

L at each occurrence independently represents a ligand derived from a chelating agent selected from the group consisting of β-ketoester represented by the following formula (1a):

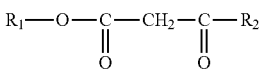

(1a)

wherein $R_1$ and $R_2$ each represent a $C_{1-18}$ aliphatic hydrocarbon group;

β-diketone represented by the following formula (1b):

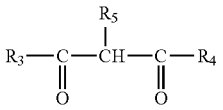

(1b)

wherein $R_3$ to $R_5$ each represent a $C_{1-18}$ aliphatic hydrocarbon group; and $C_{3-10}$ alkylene glycol;

n represents an integer of 1 to 3; and if n is 2 or more, two Rs may be coupled to each other.

2. The electrophotographic photoconductor according to claim 1, wherein the metal oxide particles are titanium oxide particles.

3. The electrophotographic photoconductor according to claim 1, wherein an average primary particle size of the metal oxide particles is 10 to 400 nm.

4. The electrophotographic photoconductor according to claim 1; wherein the photosensitive layer comprises a charge generation layer and a charge transport layer, and the charge generation layer comprises a Type titanyl phthalocyanine pigment or a mixture of a titanyl phthalocyanine pigment and a pigment of an adduct of 2,3-butanediol and titanyl phthalocyanine.

5. A process cartridge detachably mountable on an image forming apparatus, the process cartridge comprising:

the electrophotographic photoconductor according to claim 1; and at least one unit selected from the group consisting of: a charging unit for charging a surface of the electrophotographic photoconductor; a developing unit for feeding a toner to an electrostatic latent image formed on the surface of the electrophotographic photoconductor; a transferring unit for transferring the toner fed to the surface of the electrophotographic photoconductor onto a recording medium; a discharging unit for discharging the surface of the electrophotographic photoconductor after toner transfer; and a cleaning unit for removing a residual toner from the surface of the electrophotographic photoconductor; wherein the electrophotographic photoconductor and the at least one unit are integrally formed.

6. An image forming apparatus comprising:

the electrophotographic photoconductor according to claim 1;

a charging unit for charging a surface of the electrophotographic photoconductor;

an light exposing unit for light-exposing the surface of the electrophotographic photoconductor;

a developing unit for feeding a toner to an electrostatic latent image formed on the surface of the electrophotographic photoconductor;

a transferring unit for transferring the toner formed on the surface of the electrophotographic photoconductor onto a recording medium;

a discharging unit for discharging the surface of the electrophotographic photoconductor after toner transfer; and a cleaning unit for removing a residual toner from the surface of the electrophotographic photoconductor.

* * * * *